US012187975B2

(12) United States Patent
Schmitz et al.

(10) Patent No.: US 12,187,975 B2
(45) Date of Patent: Jan. 7, 2025

(54) USE OF A LUBRICATING GREASE COMPOSITION HAVING A HIGH UPPER USE TEMPERATURE

(71) Applicant: Klueber Lubrication Muenchen SE & CO. KG, Munich (DE)

(72) Inventors: Christof Schmitz, Munich (DE); Wolfgang Tiepermann, Weilheim (DE); Raphaela Makrutzki, Dietramszell-Ascholding (DE); Stefan Seemeyer, Wolfratshausen (DE)

(73) Assignee: KLUEBER LUBRICATION MUENCHEN GMBH & CO. KG, Munich (DE)

( * ) Notice: Subject to any disclaimer, the term of this patent is extended or adjusted under 35 U.S.C. 154(b) by 0 days.

(21) Appl. No.: 18/358,987

(22) Filed: Jul. 26, 2023

(65) Prior Publication Data

US 2023/0365884 A1 Nov. 16, 2023

Related U.S. Application Data

(62) Division of application No. 17/783,655, filed as application No. PCT/EP2020/080748 on Nov. 3, 2020, now abandoned.

(30) Foreign Application Priority Data

Dec. 13, 2019 (DE) ..... 10 2019 134 330.5

(51) Int. Cl.

| | |
|---|---|
| ***C10M 169/02*** | (2006.01) |
| ***C10M 107/02*** | (2006.01) |
| ***C10M 117/08*** | (2006.01) |
| ***C10M 119/24*** | (2006.01) |
| ***C10M 123/04*** | (2006.01) |
| *C10N 40/06* | (2006.01) |
| *C10N 50/10* | (2006.01) |

(52) U.S. Cl.

CPC ..... *C10M 169/02* (2013.01); *C10M 107/02* (2013.01); *C10M 117/08* (2013.01); *C10M 119/24* (2013.01); *C10M 123/04* (2013.01); *C10M 2205/0206* (2013.01); *C10M 2207/284* (2013.01); *C10M 2217/0456* (2013.01); *C10N 2040/06* (2013.01); *C10N 2050/10* (2013.01)

(58) Field of Classification Search

CPC ..... C10N 2040/06; C10N 2040/17; C10N 2050/10; C10N 2010/06

See application file for complete search history.

(56) References Cited

U.S. PATENT DOCUMENTS

| | | | | |
|---|---|---|---|---|
| 3,243,372 | A | 3/1966 | Dreher | |
| 3,514,400 | A | 5/1970 | Hotten | |
| 3,865,736 | A | 2/1975 | Fries | |
| 5,096,605 | A | 3/1992 | Waynick | |
| 2003/0176295 | A1 | 9/2003 | Ozaki et al. | |
| 2006/0154833 | A1 | 7/2006 | Katou et al. | |
| 2006/0264338 | A1 | 11/2006 | Kawamura et al. | |
| 2009/0221457 | A1* | 9/2009 | Ikezawa | C10M 141/02 508/162 |
| 2013/0267447 | A1* | 10/2013 | Bardin | C10M 169/06 508/128 |

FOREIGN PATENT DOCUMENTS

| | | | |
|---|---|---|---|
| CN | 101235338 | A | 8/2008 |
| EP | 2021439 | A1 | 2/2009 |
| EP | 2077318 | A1 | 7/2009 |
| JP | 2002053889 | A | 2/2002 |
| JP | 2006169386 | A | 6/2006 |
| JP | 2006307023 | A | 11/2006 |
| JP | 2008169370 | A | 7/2008 |
| JP | 2009298962 | A | 12/2009 |

OTHER PUBLICATIONS

Schaeffler, "Schmierung von Wälzlagern", Mar. 2013, p. 1-14. URL: http://www.schaeffler.com/remotemedien/media/_shared_media/08_media_library/01_publications/schaeffler_2/tpi/downloads_8/tpi_176_de_de.pdf.

International Search Report, dated Feb. 3, 2021.

* cited by examiner

*Primary Examiner* — Vishal V Vasisth

(74) *Attorney, Agent, or Firm* — LEYDIG, VOIT & MAYER, LTD.

(57) ABSTRACT

A lubricant grease composition is disclosed, the lubricant grease composition including a base oil and a thickener. The thickener includes an aluminum-based complex soap and a polyurea thickener, wherein the lubricant grease is configured for lubrication of surfaces of components in which an upper use temperature of the lubricant grease composition is at least 90° C.

10 Claims, No Drawings

USE OF A LUBRICATING GREASE COMPOSITION HAVING A HIGH UPPER USE TEMPERATURE

CROSS REFERENCE TO RELATED APPLICATIONS

This application is a divisional of U.S. application Ser. No. 17/783,655 filed on Jun. 9, 2022 as a U.S. National Phase application under 35 U.S.C. § 371 of International Application No. PCT/EP2020/080748, filed on Nov. 3, 2020, and claims benefit to German Patent Application No. DE 102019134330.5, filed on Dec. 13, 2019, the entire disclosures of which are hereby incorporated by reference herein.

FIELD

The present invention relates to the use of a lubricant grease composition for lubrication of surfaces in applications in which a high upper use temperature is required, and especially in the automotive industry.

BACKGROUND

In the past, lubricant greases were used predominantly for purely metallic components. In order to meet constantly rising demands on lower weight and lower costs, for example in the automotive industry, however, there is increasing use of plastic-containing components. For that reason, there is a rise in demand for lubricant greases matched to lubrication of plastic-containing friction partners and/or to a combination of metallic and plastic-containing friction partners.

An important field of use for the lubrication of plastic surfaces is the lubrication of friction partners in actuators. This is firstly because they are taking on an increasingly important role in measurement, control and regulation technology, for example in the automotive industry, and secondly because they generally have at least partly plastic-containing friction partners. But plastic-containing friction partners make different demands on lubricant greases than purely metallic components, and so the lubricant greases customarily used there generally do not give satisfactory results, for example with regard to coefficients of friction or service life.

One way of adjusting the properties of the lubricant greases is by suitable selection of the thickeners. For particular applications, aluminum complex soaps have been found to be suitable thickeners. For instance, aluminum complex soaps as thickeners for lubricant grease compositions have long been known and are described in many literature references, for example in J. L. Dreher, T. H. Koundakijan and C. F. "Manufacture and Properties of Aluminum Complex Greases", NLGI Spokesman, 107-113, 1965; H. W. Kruschwitz "The Development of Formulations for Aluminum Complex Thickener Systems" NLGI Spokesman, 51-59, 1976; H. W. Kruschwitz "The Manufacture and Uses of Aluminum Complex Greases" NLGI National Meeting Preprints 1985.

Nevertheless, the global market for greases is dominated by conventional simple lithium soaps as thickener, followed by complex lithium soaps and simple calcium soaps. Specifically in the automotive industry, where a high demand on the temperature use range is generally made (at least −40° C. to +120° C.), aluminum complex soaps are barely present. This is all the more astonishing since the use of aluminum complex soaps brings multiple advantages. Compared to simple and complex lithium soaps, one advantage here would be the better availability of the aluminum source. Specifically in the age of electromobility, the cost of lithium hydroxide has drastically increased in the last few years, and it is not possible to clearly foresee how the availability and price will develop. Furthermore, aluminum complex soaps have good water resistance, pumpability, good low-temperature characteristics and high material compatibility.

A further advantage of aluminum complex soaps is that they are capable, on account of their high shear instability, of lowering the dynamic viscosity of the lubricant. As a result, they enable the use of base oils having higher viscosities, which is advantageous especially in the case of metal/plastic friction partners. As a result of the higher lubricant film obtained thereby between the friction partners, it is thus possible to reduce wear over the lifetime. Furthermore, an elevated base oil viscosity is advantageous for noise vibration hardness (NVH) characteristics in the component.

The disadvantage of aluminum complex soaps, which is certainly also a reason why they have not found wide use in the automotive industry, is that although aluminum complex soaps do have a high dripping point (≥220° C.), this cannot be equated with the upper use temperature. Aluminum complex soaps, depending on their consistency index (NLGI), become fluid with time at temperatures above 90° C., and are thus no longer available to the friction site to be lubricated and therefore do not meet the demand from the automotive industry for a high upper use temperature, which should preferably be at least 120° C.

Accordingly, for example, EP2077318 (A1) describes an aluminum complex-free lubricant grease composition for use of plastic-containing friction partners in automobiles. The lubricant grease composition contains a base oil selected from at least one synthetic hydrocarbon oil, a synthetic ester-based oil and a synthetic ether-based oil, and a thickener selected from at least one lithium-based soap, a lithium-based complex soap and a urea-based compound.

It would therefore be desirable to obtain a lubricant grease composition based on an aluminum complex thickener which is suitable for lubrication of the surfaces of plastic-containing friction partners or of a combination of metallic and plastic-containing friction partners and which has satisfactory thermal stability in the form of an upper use temperature of preferably more than 90° C. and especially more than 120° C.

SUMMARY

In an embodiment, the present disclosure provides a lubricant grease composition comprising a base oil and a thickener including an aluminum-based complex soap and a polyurea thickener, wherein the lubricant grease is configured for lubrication of surfaces of components in which an upper use temperature of the lubricant grease composition is at least 90° C.

DETAILED DESCRIPTION

This object is achieved in accordance with the invention by the use of a lubricant grease composition comprising

- a base oil,
- a thickener comprising an aluminum-based complex soap and a polyurea thickener, for lubrication of the surfaces of components in applications in which an upper use temperature of the lubricant grease composition of at least 90° C., for example 90° C. to 180° C. and/or 90° C. to 160° C. and/or 90° C. to 150° C., preferably at least 100° C., for example 100° C. to 180° C. and/or 100° C. to 160° C. and/or 100° C. to 150° C., more preferably 110° C. to 180° C. and/or 110° C. to 170° C. and/or 110° C. to 160° C. and/or 110° C. to 150° C., is required.

It has been found in accordance with the invention that, surprisingly, the use of a thickener comprising an aluminum-based complex soap in combination with a polyurea thickener makes it possible to obtain a lubricant grease composition of excellent suitability for lubrication of the surfaces of components in applications in which a high upper use temperature of the lubricant grease composition is required. Thus, the lubricant grease composition is of excellent suitability for applications in the automotive sector, since the use temperatures required in the automotive sector, which are typically in the range from −40° C. to +120° C., can be achieved without difficulty. Examples of applications in which an upper use temperature of the lubricant grease composition of at least 90° C. is required is the lubrication of ball joints, spur gears, worm gears and planetary gears and actuators of brush-operated or brushless DC motors (DC, BLDC motors) and/or AC motors (AC, BLAC motors).

The lubricant grease composition used in accordance with the invention preferably has an upper use temperature of at least 90° C., for example 90° C. to 180° C. and/or 90° C. to 160° C. and/or 90° C. to 150° C., preferably at least 100° C., for example 100° C. to 180° C. and/or 100° C. to 160° C. and/or 100° C. to 150° C., more preferably 110° C. to 180° C. and/or 110° C. to 170° C. and/or 110° C. to 160° C. and/or 110° C. to 150° C.

An upper use temperature of the lubricant grease composition is understood to mean the highest temperature at which the lubricant grease composition can be used without losing its use capability. The upper use temperature can be determined in accordance with the invention by measuring oil separation at various temperatures. According to the invention, the upper use temperature of the lubricant grease composition is the highest temperature at which the lubricant grease composition has an oil separation to ASTM D6184-17 (24 h/X° C.) of less than 12% by weight. The lubricant grease composition preferably has an oil separation to ASTM D6184-17 (24 h/100° C.) of less than 12% by weight, more preferably of less than 10% by weight and especially less than 6% by weight. Likewise preferably, the lubricant grease composition has an oil separation to ASTM D6184-17 (24 h/100° C., then 24 h/110° C.) of less than 16% by weight, more preferably of less than 14% by weight and especially less than 13% by weight. Likewise preferably, the lubricant grease composition has an oil separation to ASTM D6184-17 (24 h/100° C., then 24 h/110° C., then 24 h/120° C.) of less than 20% by weight, more preferably of less than 15% by weight and especially less than 12% by weight.

In an embodiment of the invention, the lubricant grease composition has a use temperature range from −60° C. to +180° C. and/or of −50° C. to +160° C., and/or of −40° C. to +150° C. and/or of −40° C. to +140° C. and/or of −40° C. to +120° C. A use temperature range of the lubricant grease composition is understood to mean the temperature range in which the lubricant grease composition can be used without losing its use capability. For instance, according to the invention, a lubricant grease composition at its use temperature has an oil separation to ASTM D6184-17 (24 h/X° C.) of less than 12% by weight. In addition, a lubricant grease composition at its use temperature has a flow pressure (DIN 51805-2:2016-09) of not more than 1400 mbar.

Nevertheless, the lubricant grease composition can also be used at temperatures higher or lower than the abovementioned temperatures, provided that these temperatures occur only for a short period of time, for example less than 10 minutes.

The invention further provides for the use of a lubricant grease composition comprising a base oil, a thickener comprising an aluminum-based complex soap and a polyurea thickener, for lubrication of the surfaces of components at temperatures that are at least intermittently at least 90° C., for example 90° C. to 180° C. and/or 90° C. to 160° C. and/or 90° C. to 150° C., preferably at least 100° C., for example 100° C. to 180° C. and/or 100° C. to 160° C. and/or 100° C. to 150° C., more preferably 110° C. to 180° C. and/or 110° C. to 170° C. and/or 110° C. to 160° C. and/or 110° C. to 150° C.

In an embodiment of the invention, the temperature is maintained for a period of at least 10 minutes, more preferably of at least 20 minutes, more preferably of at least 40 minutes and especially of at least 60 minutes.

The high thermal stability of the lubricant grease composition was surprising in that the use of aluminum-based complex soaps, as elucidated above, is known to lead to lubricant greases having comparatively low thermal stability of generally below 90° C. Without committing to any mechanism, it is suspected that a synergism develops between aluminum complex soap and polyurea thickener that increases the thermal stability of the aluminum complex soap. This is probably because the two thickener components have good mutual miscibility, and hence the result is a hybrid thickener system. The distinctly higher upper use temperature of the polyurea thickener has a positive influence on the upper use temperature of the aluminum-based complex soap without adversely affecting the general positive properties of the aluminum-based complex soap.

A polyurea thickener is understood to mean a reaction product of a diisocyanate, preferably 2,4-diisocyanatotoluene, 2,6-diisocyanatotoluene, 4,4'-diisocyanatodiphenylmethane, 2,4'-diisocyanatophenylmethane, 4,4'-diisocyanatodiphenyl, 4,4'-diisocyanato-3,3'-dimethylphenyl, 4,4'-diisocyanato-3,3'-dimethylphenylmethane, which may be used individually or in combination, with an amine of the general formula R'2-N—R, or a diamine of the general formula R'2-N—R—NR'2 where R is an aryl, alkyl or alkylene radical having 2 to 22 carbon atoms and R' is identical or different and is a hydrogen or an alkyl, alkylene or aryl radical having 2 to 22 carbon atoms, or with mixtures of amines and diamines.

The proportion of the polyurea thickener in the lubricant grease composition of the invention is preferably 1% by weight to 11% by weight, more preferably from 2% by weight to 10% by weight, and especially from 3% by weight to 9% by weight, based in each case on the total weight of the lubricant grease composition.

According to the invention, it is possible in principle to use a wide variety of different aluminum-based complex soaps that are customarily used in lubricant grease compositions. In one embodiment of the present invention, aluminum-based complex soaps of the Formula 1: general structure of aluminum complex soap

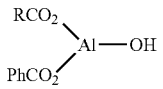

are preferred on account of their good availability. The fatty acid radical R here is preferably an aliphatic hydrocarbyl radical having 4 to 28 carbon atoms ($R=C_4-C_{28}$). Preference is given here to an even number of carbon atoms since this occurs in most naturally occurring fatty acids. More preferably, $R=C_{12}-C_{22}$. Further preferably, the R radicals are derived from fatty acids selected from the group consisting of lauric acid, palmitic acid, myristic acid, stearic acid and mixtures thereof.

Aluminum-based complex soaps as shown in formula 1 are aluminum carboxylate compounds that can be prepared by a reaction of a fatty acid, an aromatic carboxylic acid and an aluminum-alcohol derivative. Commercially used aluminum alkoxides are aluminum isopropoxide or trioxyaluminum triisopropoxide. A simple route to preparation of the aforementioned aluminum-based complex soaps comprises the reaction between a trioxyaluminum triisopropoxide (Al trimer for short), a fatty acid and a benzoic acid:

Formula 2: Reaction of an aluminum alkoxide (Pri = isopropanol) with benzoic acid and a fatty acid

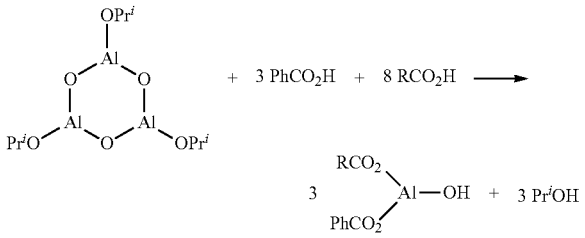

Alternatively, it is also possible to convert an intermediate, for example polyoxyaluminum stearate, to the corresponding complex soap. In grease production, this obviates the need to release a low molecular weight alcohol, for example isopropyl alcohol.

What is advantageous about the use of the aluminum-based complex soaps as thickener, as elucidated above, is that they combine good availability with low cost. Furthermore, aluminum complex soaps have good water resistance, pumpability, good low-temperature characteristics and high material compatibility.

The proportion of the aluminum-based complex soap in the lubricant grease composition of the invention is preferably from 1% by weight to 11% by weight, more preferably from 2% by weight to 10% by weight and especially from 3% by weight to 9% by weight, based in each case on the total weight of the lubricant grease composition.

In an embodiment of the invention, the proportion of aluminum-based complex soap and polyurea thickener together is from 2% by weight to 22% by weight, more preferably from 4% by weight to 20% by weight and especially from 6% by weight to 18% by weight, based in each case on the total weight of the lubricant grease composition.

In some embodiments the invention encompasses the use of the lubricant grease composition for lubrication of the surfaces of plastic-containing friction partners or of a combination of metallic and plastic-containing friction partners and especially of friction partners of the aforementioned type in actuators, especially in the automotive sector.

Suitable base oils are customary lubricant oils that are liquid at room temperature (20° C.). The base oil preferably has a kinematic viscosity of 18 $mm^2/s$ to 20 000 $mm^2/s$, especially from 30 $mm^2/s$ to 400 $mm^2/s$, at 40° C. Base oils are distinguished between mineral oils and synthetic oils. A base oil is understood to mean the customary base fluids used for the production of lubricants, especially oils that are assigned to groups I, II, II+, III, IV or V according to the classification of the American Petroleum Institute (API) [NLGI Spokesman, N. Samman, volume 70, number 11, p. 14 et seq.]. Mineral oils are classified by API group. API Group I are mineral oils consisting, for example, of naphthenic or paraffinic oils. If these mineral oils, by comparison with API Group I oils, have been chemically modified, have a low aromatics level and low sulfur level and have a low proportion of saturated compounds and hence improved viscosity/temperature characteristics, the oils are classified as API Group II and III. API Group III also includes what are called gas-to-liquid oils that are produced not from the refining of crude oil but by the chemical conversion of natural gas.

Synthetic oils include polyethers, esters, polyesters, preferably polyalphaolefins, especially metallocene polyalphaolefins, polyethers, perfluoropolyalkyl ethers (PFPAE), alkylated naphthalenes, silicone oils and alkylaromatics and mixtures thereof. The polyether compound may have free hydroxyl groups, but may also have been fully etherified or end group-esterified and/or have been prepared from a starter compound having one or more hydroxyl and/or carboxyl groups (—COOH). Also possible are polyphenol ethers, optionally alkylated, as the sole components or even better as mixed components.

Suitably usable are esters of an aromatic and/or aliphatic di-, tri- or tetracarboxylic acid with one or a mixture of C7 to C22 alcohols, esters of trimethylolpropane, pentaerythritol or dipentaerythritol with aliphatic C7 to C22 carboxylic acids, esters of C18 dimer acids with C7 to C22 alcohols, complex esters, as individual components or in any mixture.

Likewise suitable are silicone oils, native oils and derivatives of native oils.

Base oils particularly preferred in accordance with the invention are polyalphaolefins, especially metallocene polyalphaolefins, and naphthenic mineral oils according to the API Group I classification.

In an embodiment of the invention, the proportion of the base oil in the lubricant grease composition of the invention is from 55% by weight to 90% by weight, more preferably from 60% by weight to 95% by weight, and especially from 68% by weight to 92% by weight, based in each case on the total weight of the lubricant grease composition.

As well as base oil(s) and thickener(s), the composition of the invention may also contain further additives, for example antioxidants, anticorrosives, lubricity improvers, high-pressure and antiwear additives, metal deactivators, viscosity and friction improvers, dyes, friction reducers.

The addition of antioxidants can reduce or even prevent the oxidation of the lubricant grease composition of the invention, especially on use thereof. Oxidation can give rise to unwanted free radicals, resulting in an increased level of occurrence of break down reactions of the lubricant. The addition of antioxidants stabilizes the lubricant grease composition.

Antioxidants that are particularly suitable in accordance with the invention are the following compounds: styrenized diphenylamines, diaromatic amines, phenolic resins, thiophenolic resins, phosphites, butylated hydroxytoluene, butylated hydroxyanisole, phenyl-alpha-naphthylamine, phenyl-beta-naphthylamine, octylated/butylated diphenylamine, di-alpha-tocopherol, di-tert-butylphenyl, benzenepropanoic acid, sulfur-containing phenol compounds and mixtures of these components.

In addition, the lubricant grease composition may contain further additives, especially anticorrosion additives, metal deactivators or ion-complexing agents. These include triazoles, imidazolines, N-methylglycine (sarcosine), benzotriazole derivatives, N,N-bis(2-ethylhexyl)-ar-methyl-1H-benzotriazole-1-methanamine; n-methyl-N-(1-oxo-9-octadecenyl)-glycine, mixtures of phosphoric acid and mono- and diisooctyl esters reacted with ($C_{11-14}$)-alkylamines, mixtures of phosphoric acid and mono- and diisooctyl esters reacted with tert-alkylamine and primary ($C_{12-14}$)-amines, dodecanoic acid, triphenyl phosphorothionate and amine phosphates. Commercially available additives are as follows: IRGAMET® 39, IRGACOR® DSS G, Amin O; SARKOSYL® O (Ciba), COBRATEC® 122, CUVAN® 303, VANLUBE®9123, CI-426, CI-426EP, CI-429 and CI-498.

Further conceivable antiwear additives are amines, amine phosphates, phosphates, thiophosphates, phosphorothionates and mixtures of these components. The commercially available antiwear additives include IRGALUBE® TPPT, IRGALUBE® 232, IRGALUBE® 349, IRGALUBE®211 and ADDITIN® RC3760 Liq 3960, FIRC-SHUN® FG 1505 and FG 1506, NA-LUBER KR-015FG, LUBEBOND®, FLUORO® FG, SYNALOX®40-D. ACHESON® FGA 1820 and ACHESON® FGA 1810.

The proportion of the further additives is preferably from 1% by weight to 30% by weight, more preferably from 1.5% by weight to 25% by weight, and especially from 2% by weight to 20% by weight, in each case based on the total weight of the lubricant grease composition.

In addition, the lubricant grease composition may contain solid lubricants such as PTFE, boron nitride, polymer powders, for example PTFE, polyamides or polyimides, pyrophosphate, metal oxides, for example zinc oxide or magnesium oxide, metal sulfides, for example zinc sulfide, molybdenum sulfide, tungsten sulfide or tin sulfide, pyrophosphates, thiosulfates, magnesium carbonate, calcium carbonate, calcium stearate, carbon polymorphs, for example carbon black, graphite, graphene, nanotubes, fullerenes, SiO2 polymorphs, melanin cyanurate, or a mixture thereof.

The proportion of the solid lubricants is preferably from 1% by weight to 30% by weight, more preferably from 1.5% by weight to 25% by weight, and especially from 2% by weight to 20% by weight, based in each case on the total weight of the lubricant grease composition.

Further preferably, the lubricant grease composition has a worked penetration, determined to DIN ISO 2137:2016-12, of 265 to 385 0.1 mm. According to the National Lubricating Grease Institute (NLGI) scale, this corresponds to a consistency class no. 0-2 as per DIN 51818:1981-12.

In an embodiment of the invention, the lubricant grease composition has the following composition:

55% to 96% by weight of base oil,

1% to 11% by weight of polyurea thickener.

1% to 11% by weight of aluminum-based complex soap,

1% to 30% by weight of additives,

1% to 30% by weight of solid lubricants.

The invention is elucidated in detail hereinafter with reference to various examples.

Production of a Lubricant Grease Composition of the Invention:

A standard production method for lubricant greases is used. Heated reactors are used, which may also be designed as an autoclave or vacuum reactor. If required, the resultant grease can be homogenized, filtered and/or devolatilized.

Production method A: Formation of a lubricant grease composition of the invention by separate production of an aluminum-based complex soap (base grease A) and a polyurea thickener (base grease B-H) with subsequent mixing and additization Base Grease A (Aluminum-Based Complex Soap):

A heatable reaction vessel equipped with a stirrer system suitable for the production of lubricant greases is initially charged with the base oil or a portion of the base oil or oil mixture. The aluminum-based complex soap is produced therein by reaction of polyoxyaluminum stearate with benzoic acid and stearic acid. Subsequently, the reaction mixture is heated, wherein peak temperatures up to 210° C. may occur, in order to drive out the water and to melt the thickener. The subsequent cooling phase determines the morphology of the thickener. It is possible here to use residual base oil for controlled adjustment of the consistency.

Base Greases B-H (Polyurea Thickener):

A heatable reaction vessel equipped with a stirrer system suitable for the production of lubricant greases is initially charged with the base oil or a portion of the base oil or oil mixture. Subsequently, the isocyanate component(s) is/are added and heated to 60° C. while stirring. In a separate reaction vessel, a portion of the base oil is mixed with the amine component(s) at 60° C. until the solution is homogeneous. The amine solution is added while stirring the isocyanate solution and heated up to 200° C. The subsequent cooling phase determines the morphology of the thickener. It is possible here to use residual base oil for controlled adjustment of the consistency.

Base grease A and polyurea grease (base grease B-H) are mixed in a heatable reaction vessel equipped with a stirrer system suitable for the production of lubricant greases. The additives are added while stirring over and above 120° C. Once the desired consistency has been attained, the product is homogenized, and optionally filtered and devolatilized.

Production method B: Formation of the lubricant grease composition by sequential production of an aluminum-based complex soap and a polyurea thickener in the base oil with subsequent addition of the additives. A heatable reaction vessel equipped with a stirrer system suitable for the production of lubricant greases is initially charged with the base oil or a portion of the base oil or oil mixture. The aluminum-based complex soap is produced therein by reaction of polyoxyaluminum stearate with benzoic acid and stearic acid. Subsequently, the reaction mixture is heated, wherein peak temperatures up to 210° C. may occur, in order to drive out the water and to melt the thickener. Subsequently, the brew is cooled down to 60° C., and the isocyanate component(s) is/are added and melted while stirring. In a separate reaction vessel, a portion of the base oil is mixed with the amine component(s) at 60° C. until the solution is homogeneous. The amine solution is added while stirring the isocyanate solution and heated up to 200° C. The subsequent cooling phase determines the morphology of the thickener. It is possible here to use residual base oil for controlled adjustment of the consistency. The additives are added while stirring over and above 120° C. Once the desired consistency has been attained, the product is homogenized, and optionally filtered and devolatilized.

By the above-described process, the lubricant grease compositions shown in table 1 and table 2 (base greases A 1-2/base greases B-H/hybrids 1-15) are produced.

A comparison of production methods A and B is shown in table 3. Small difference in the penetration values shows that both production methods are suitable for production of a corresponding hybrid grease.

Penetration is determined to DIN ISO 2137:2016-12. What is measured is worked penetration after 60 twin strokes.

Oil separation is determined to ASTM D6184-17 with the differences described below. For table 4, the contact time is different and is 72 h, with, after every 24 h, i) determination of the amount of oil separated and ii) an increase in the temperature by 10° C. For table 5, the contact time is 30 h. A separate measurement is effected here at 130° C. and at 150° C.

TABLE 1

Production of base greases

| | A1 | A2 | B | C | D | E | F | G | H |
|---|---|---|---|---|---|---|---|---|---|
| Toluene 2,4-/2,6-diisocyanate | | | | | | X | X | X | |
| Diphenylmethane 4,4'-diisocyanate | | | X | X | X | | X | X | X |
| Benzoic acid | X | X | | | | | | | |
| Cyclohexylamine | | | X | X | | | | | |
| Ethylenediamine | | | | | | | | | X |
| Oleylamine | | | | X | X | X | X | X | |
| PAO | X | X | X | X | X | X | X | X | |
| Polyoxyaluminum stearate | X | X | | | | | | | |
| p-Phenetidine | | | | | | | X | | X |
| n-Octylamine | | | | X | X | X | X | X | X |
| Stearic acid | X | X | | | | | | | |
| Thickener content [% by wt.] | 15 | 12 | 15 | 13 | 15 | 15 | 15 | 15 | 15 |
| Penetration (1/10 mm) | 330 | 346 | 285 | 186 | 185 | | 198 | 234 | 340 |

TABLE 2

Production of hybrid greases

| | AK component [% by wt.] | PU component [% by wt.] | PAO [% by wt.] | Penetration [1/10 mm] |
|---|---|---|---|---|
| Hybrid 1 | 50.0/A 2 | 50.0/E | — | 339 |
| Hybrid 2 | 48.5/A 2 | 24.0/G | 27.5 | 336 |
| Hybrid 3 | 47.0/A 2 | 23.5/C | 29.0 | 343 |
| Hybrid 4 | 53.0/A 2 | 26.5/H | 20.0 | 362 |
| Hybrid 5 | 62.5/A 2 | 32.5/B | 5.0 | 337 |
| Hybrid 6 | 62.5/A 2 | 32.5/H | 5.0 | 349 |
| Hybrid 7 | 73.5/A 2 | 6.5/F | 20.0 | 349 |
| Hybrid 8 | 66.5/A 2 | 13.5/F | 20.0 | 346 |

TABLE 2-continued

Production of hybrid greases

| | AK component [% by wt.] | PU component [% by wt.] | PAO [% by wt.] | Penetration [1/10 mm] |
|---|---|---|---|---|
| Hybrid 9 | 53.5/A 2 | 26.5/F | 20.0 | 337 |
| Hybrid 10 | 40.0/A 1 | 40.0/G | 20.0 | 330 |
| Hybrid 11 | 37.5/A 1 | 37.5/C | 25.0 | 330 |
| Hybrid 12 | 50.0/A 1 | 50.0/H | — | 361 |
| Hybrid 13 | 50.0/A 1 | 50.0/B | — | 342 |
| Hybrid 14 | 35.0/A 1 | 35.0/F | 30.0 | 320 |
| Hybrid 15 | 32.5/A 1 | 32.5/D | 35.0 | 325 |

TABLE 3

Comparison of production methods A/B using two hybrid greases with different thickener contents

| | 1-1 | 1-2 | 2-1 | 2-2 | 3-1 | 3-2 | 4-1 | 4-2 |
|---|---|---|---|---|---|---|---|---|
| Diphenylmethane 4,4'-diisocyanate | X | X | X | X | X | X | X | X |
| Benzoic acid | X | X | X | X | X | X | X | X |
| Oleylamine | X | X | X | X | X | X | X | X |
| PAO | X | X | X | X | X | X | X | X |
| Polyoxyaluminum stearate | X | X | X | X | X | X | X | X |
| n-Octylamine | X | X | X | X | X | X | X | X |
| Stearic acid | X | X | X | X | X | X | X | X |
| Antioxidant package | X | X | X | X | X | X | X | X |
| Wear resistance package | X | X | X | X | X | X | X | X |
| Anticorrosive package | X | X | X | X | X | X | X | X |

TABLE 3-continued

| Comparison of production methods A/B using two hybrid greases with different thickener contents | | | | | | | | |
|---|---|---|---|---|---|---|---|---|
| Viscosity improver | X | X | X | X | X | X | X | X |
| Friction modifier | X | X | X | X | X | X | X | X |
| Thickener content of AK [% by wt.] | 6 | 6 | 3 | 3 | 4.8 | 4.8 | 7.2 | 7.2 |
| Thickener content of PU [% by wt.] | 6 | 6 | 3 | 3 | 7.2 | 7.2 | 4.8 | 4.8 |
| Production method A | X | | X | | X | | X | |
| Production method B | | X | | X | | X | | X |
| Penetration (1/10 mm) | 290 | 289 | 370 | 390 | 305 | 288 | 301 | 305 |
| | 5-1 | 5-2 | 6-1 | 6-2 | 7-1 | 8-2 | 8-1 | 8-2 |
| Toluene 2,4-/2,6-diisocyanate | X | X | X | X | X | X | X | X |
| Diphenylmethane 4,4'-diisocyanate | X | X | X | X | X | X | X | X |
| Benzoic acid | X | X | X | X | X | X | X | X |
| Oleylamine | X | X | X | X | X | X | X | X |
| PAO | X | X | X | X | X | X | X | X |
| Polyoxyaluminum stearate | X | X | X | X | X | X | X | X |
| p-Phenetidine | X | X | X | X | X | X | X | X |
| n-Octylamine | X | X | X | X | X | X | X | X |
| Stearic acid | X | X | X | X | X | X | X | X |
| Antioxidant package | X | X | X | X | X | X | X | X |
| Wear resistance package | X | X | X | X | X | X | X | X |
| Anticorrosive package | X | X | X | X | X | X | X | X |
| Viscosity improver | X | X | X | X | X | X | X | X |
| Friction modifier | X | X | X | X | X | X | X | X |
| Thickener content of AK [% by wt.] | 6 | 6 | 5 | 5 | 7.2 | 7.2 | 4.8 | 4.8 |
| Thickener content of PU [% by wt.] | 6 | 6 | 5 | 5 | 4.8 | 4.8 | 7.2 | 7.2 |
| Production method A | X | | X | | X | | X | |
| Production method B | | X | | X | | X | | X |
| Penetration (1/10 mm) | 335 | 340 | 350 | 350 | 340 | 340 | 310 | 305 |

TABLE 4

| Determination of oil separation to ASTM D6184-17 after 24 h at 100° C., after +24 h at 110° C., and after +24 h at 120° C. | | | |
|---|---|---|---|
| Specimen | 24 h/100° C. [% by wt.] | 24 h/110° C. [% by wt.] | 24 h/120° C. [% by wt.] |
| Base grease A | 12.76 | 16.95 | 21.42 |
| Hybrid 2 | 5.59 | 8.74 | 11.63 |
| Hybrid 3 | 6.22 | 8.92 | 11.33 |
| Hybrid 5 | 4.78 | 7.35 | 9.57 |
| Hybrid 6 | 8.21 | 10.78 | 12.67 |
| Hybrid 7 | 9.64 | 13.29 | 15.95 |
| Hybrid 8 | 6.41 | 9.27 | 11.86 |
| Hybrid 9 | 4.84 | 6.79 | 8.71 |

TABLE 5

| Determination of oil separation to ASTM D6184-17 at 130° C. and 150° C. for 30 h each | | |
|---|---|---|
| | 30 h/130° C. | 30 h/150° C. |
| Grease A 1 | 12.0 | 27.0 |
| Grease A 2 | 18.3 | — |
| Hybrid 10 | 7.7 | 9.4 |
| Hybrid 11 | 3.4 | 5.6 |
| Hybrid 12 | 9.8 | 8.2 |
| Hybrid 13 | 7.1 | 10.1 |
| Hybrid 14 | 9.8 | 12.0 |
| Hybrid 15 | 8.6 | 10.1 |

The following conclusions can be drawn from the results:

Table 2 shows that the hybrid greases can be produced with a multitude of combinations between a thickener comprising a complex soap on aluminum and a polyurea thickener. Table 3 shows that both the production processes named are suitable for formulating comparable greases. It is possible here to vary both the content of the thickener based on an aluminum complex soap and the content of polyurea thickener with respect to one another and also overall.

Table 4 and table 5 show from the comparison of the oil separations that hybrid greases based on a combination of a thickener comprising a complex soap on aluminum and a polyurea thickener are superior to the conventional aluminum complex soaps at higher use temperatures.

While subject matter of the present disclosure has been illustrated and described in detail in the drawings and foregoing description, such illustration and description are to be considered illustrative or exemplary and not restrictive. Any statement made herein characterizing the invention is also to be considered illustrative or exemplary and not restrictive as the invention is defined by the claims. It will be understood that changes and modifications may be made, by those of ordinary skill in the art, within the scope of the following claims, which may include any combination of features from different embodiments described above.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A method of lubricating surfaces of plastic-containing friction partners, the method comprising:

providing a lubricant grease composition having an upper use temperature of at least 90° C., the lubricant grease composition comprising:

a base oil, wherein the base oil comprises one or more of polyalphaolefins, metallocene polyalphaolefins, and naphthenic mineral oils according to the API GroupI classification; and a thickener comprising an aluminum-based complex soap and a polyurea thickener; and lubricating the surfaces of plastic-containing friction partners or of a combination of metallic and plastic-containing friction partners;

wherein the polyurea thickener is a reaction product of a diisocyanate selected from the group consisting of 2,4-diisocyanatotoluene, 2,6-diisocyanatotoluene, 4,4'-diisocyanatodiphenylmethane, 2,4'-diisocyanatophenyl-methane, 4,4'-diisocyanatodiphenyl, 4,4'-diisocyanato-3,3'-dimethylphenyl, 4,4'-diisocyanto-3,3'-dimethyl-phenylmethane, which may be used individually or in combination, with an amine of the general formula R'2-N—R, or a diamine of the general formula R'2-N—R—NR'2 where R is an aryl, alkyl or alkylene radical having 2 to 22 carbon atoms and R' is identical or different and is a hydrogen or an alkyl, alkylene or aryl radical, or with mixtures of amines and diamines;

wherein the aluminum-based complex soap has the formula (A)

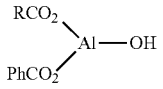

(A)

where R is an aliphatic hydrocarbyl radical having 4 to 28 carbon atoms;

wherein R is derived from one or more fatty acids selected from the group consisting of lauric acid, palmitic acid, myristic acid, and stearic acid;

wherein the base oil has a kinematic viscosity of 18 $mm^2/s$ to 20,000 $mm^2/s$ at 40° C.

wherein a proportion of the polyurea thickener in the lubricant grease composition is 1% by weight to 11% by weight based on the total weight of the lubricant grease composition; and wherein a proportion of the aluminum-based complex soap in the lubricant grease composition is from 1% by weight to 11% by weight based on the total weight of the lubricant grease composition.

2. A method of lubricating surfaces of plastic-containing friction partners, the method comprising:

providing a lubricant grease composition having an upper use temperature of at least intermittently at least 90° C., the lubricant grease composition comprising:

a base oil, wherein the base oil comprises one or more of polyalphaolefins, metallocene polyalphaolefins, and naphthenic mineral oils according to the API Group I classification; and a thickener comprising an aluminum-based complex soap and a polyurea thickener; and lubricating the surfaces of plastic-containing friction partners or of a combination of metallic and plastic-containing friction partners wherein the polyurea thickener is a reaction product of a diisocyanate selected from the group consisting of 2,4-diisocyanatotoluene, 2,6-diisocyanatotoluene, 4,4'-diisocyanatodiphenylmethane, 2,4'-diisocyanatophenyl-methane, 4,4'-diisocyanatodiphenyl, 4,4'-diisocyanato-3,3'-dimethylphenyl, 4,4'-diisocyanto-3,3'-dimethyl-phenylmethane, which may be used individually or in combination, with an amine of the general formula R'2-N—R, or a diamine of the general formula R'2-N—R—NR'2 where R is an aryl, alkyl or alkylene radical having 2 to 22 carbon atoms and R' is identical or different and is a hydrogen or an alkyl, alkylene or aryl radical, or with mixtures of amines and diamines;

wherein the aluminum-based complex soap has the formula (A)

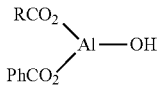

(A)

where R is an aliphatic hydrocarbyl radical having 4 to 28 carbon atoms;

wherein R is derived from one or more fatty acids selected from the group consisting of lauric acid, palmitic acid, myristic acid, and stearic acid;

wherein the base oil has a kinematic viscosity of 18 $mm^2/s$ to 20,000 $mm^2/s$ at 40° C.

wherein a proportion of the polyurea thickener in the lubricant grease composition is 1% by weight to 11% by weight based on the total weight of the lubricant grease composition; and wherein a proportion of the aluminum-based complex soap in the lubricant grease composition is from 1% by weight to 11% by weight based on the total weight of the lubricant grease composition.

3. The method of claim 1, wherein the lubricant grease composition has a use temperature range of −60° C. to +180°.

4. The method of claim 2, wherein the lubricant grease is configured for lubrication of surfaces of components when the use temperature is maintained for a period of at least 10 minutes.

5. The method of claim 1, wherein the combination of metallic and plastic-containing friction partners are in actuators in the automotive sector.

6. The method of claim 1, wherein the lubricant grease composition has an oil separation according to ASTM D 6184-17 (24 h/100° C.) of less than 12% by weight and/or according to ASTM D 6184-17 (24 h/100° C., then 24 h/110° C.) of less than 16% by weight and/or according to ASTM D 6184-17 (24 h/100° C., then 24 h/110° C., then 24 h/120° C.) of less than 20% by weight.

7. The method of claim 1, wherein the lubricant grease composition has the following composition:

55% to 96% by weight of base oil,

1% to 11% by weight of polyurea thickener,

1% to 11% by weight of aluminum-based complex soap,

1% to 30% by weight of additives, and

1% to 30% by weight of solid lubricants.

8. The method of claim 1, wherein the lubricant grease composition has an oil separation according to ASTM D 6184-17 (24 h/100° C.) of less than 12% by weight.

9. The method of claim 1, wherein the lubricant grease composition has an oil separation according to ASTM D 6184-17 (24 h/100° C.) of less than 6% by weight.

10. The method of claim 1, wherein the lubricant grease composition has an upper use temperature of 110° C. to 180° C.

* * * * *